US007121869B2

(12) United States Patent
Chen

(10) Patent No.: US 7,121,869 B2
(45) Date of Patent: Oct. 17, 2006

(54) POWER CORD ELECTRIC CONNECTION STRUCTURE

(75) Inventor: Michael Chen, Taipei Hsien (TW)

(73) Assignee: Topower Computer Industrial Co., Ltd., Taipei Hsien (TW)

( * ) Notice: Subject to any disclaimer, the term of this patent is extended or adjusted under 35 U.S.C. 154(b) by 0 days.

(21) Appl. No.: 11/023,485

(22) Filed: Dec. 29, 2004

(65) Prior Publication Data

US 2006/0141848 A1 Jun. 29, 2006

(51) Int. Cl.
*H01R 11/20* (2006.01)

(52) U.S. Cl. ..... 439/404; 439/443

(58) Field of Classification Search ..... 439/389, 439/404 X, 405, 417, 425, 443 I, 484, 874
See application file for complete search history.

(56) References Cited

U.S. PATENT DOCUMENTS 5,057,036 A * 10/1991 Dickie ..... 439/484
5,446,622 A * 8/1995 Landry et al. ..... 361/737
5,603,633 A * 2/1997 Satoh ..... 439/404
5,725,400 A * 3/1998 Morikawa et al. ..... 439/874
6,083,037 A * 7/2000 Gunther et al. ..... 439/443
6,093,047 A * 7/2000 Ann ..... 439/398
6,142,818 A * 11/2000 Hollesen et al. ..... 439/395
6,247,977 B1 * 6/2001 Tanaka et al. ..... 437/874
6,500,023 B1 * 12/2002 Duong et al. ..... 439/484
6,549,427 B1 * 4/2003 Johnston ..... 361/823
6,722,914 B1 * 4/2004 Blaha ..... 439/404
6,749,458 B1 * 6/2004 Kuo et al. ..... 439/484
6,790,075 B1 * 9/2004 Sung ..... 439/499
6,855,000 B1 * 2/2005 Wu ..... 439/484

* cited by examiner

*Primary Examiner*—Thanh-Tam Le
(74) *Attorney, Agent, or Firm*—Birch, Stewart, Kolasch & Birch, LLP.

(57) ABSTRACT

A power cord electric connection structure includes a power cord and a terminal socket that are electrically connected in a vertical direction. The power cord has a connecting portion in which the conductive core is bare and exposed outside the insulation layer. The terminal socket has a coupling trough which contains a conductive terminal to form a plane contact with the bare conductive core so that a secure electric connection is established, and wiring management of the power cord and terminal socket is easier.

18 Claims, 7 Drawing Sheets

POWER CORD ELECTRIC CONNECTION STRUCTURE

FIELD OF THE INVENTION

The present invention relates to a power cord electric connection structure and particularly to a connection structure adopted for use on electric equipment to electrically connect a power cord and a terminal socket to transmit electricity.

BACKGROUND OF THE INVENTION

Power supply is a main factor affecting the operation stability and quality of a computer system. As advance of technology increases, demand of electronic equipment (such as hard disks, central processors, burners, and the like) for higher electricity quality is also greater. Unstable power supply will result in poorer output electricity quality and disruption of computer system and electronic equipment operation. In serious situations, important data could be lost and result in severe damages.

Besides electricity quality, wiring of power cords of power supply is also a problem that users often encounter. Referring to FIG. 1, a conventional power cord a and a terminal socket a1 (such as SATA, AT/ATX sockets) usually are connected horizontally. When the terminal socket a1 is plugged in an electronic equipment, in addition to the existing length of the terminal socket a1, a bending length for the power cord a has to be reserved. As the present computer system has a limited interior space, the power cord a and the terminal socket a1 take too much space. Wiring for the spared line becomes a problem. Ineffective wiring could result in undesirable heated air ventilation and poor heat dispersion, and affect computer system operation. This is a particular concern to the designers and manufacturers of computer cases. As the computer case generally adopts a side connection design to improve the problem of a small gap between the electronic equipment and the power supply that affects heat dispersion and wiring, and provide hot swap electronic devices. If the length of the power cord a and the terminal socket a1 is too big, the computer case has to be redesigned (such as increase the total width of the case), design and fabrication costs become higher. It is not economic effective.

To remedy this problem, referring to FIG. 2, some vendors adopt a piercing power cord b like telephone lines. The concept is to connect a power cord b with a terminal socket b1 in a vertical fashion. The bending length required on the power cord a1 may be saved, and the aforesaid problems are eliminated. But to pierce the power cord b, the terminal socket b1 should have a sharp end on a conductive terminal b2 to penetrate the insulation layer on the outer side. The sharp end is in contact with the conductive core of the power cord b in a point or line contact fashion to establish electric connection. As the electronic equipment requires a large amount of current, the aforesaid electric connection tends to generate pulse sparks. Moreover, vendors and users often cannot make sure that the electric connection is well established by such a connection. This could result in poor electric transmission quality. Furthermore, both the piercing power cord b and the conventional power cord a are difficult to plug in and pull out. Because of these disadvantages the power cord b and terminal socket b1 are still not widely used in the computer systems.

SUMMARY OF THE INVENTION

The primary object of the invention is to solve the aforesaid disadvantages. The present invention employs a vertical connection for a power cord and a terminal socket to establish electric connection. The power cord has a bare conductive core exposed outside the insulation layer at a connecting portion to be connected to the terminal socket. The terminal socket has a coupling trough which contains a conductive terminal to connect to the bare conductive core to form a plane contact so that a secure electric connection is established and wiring management of the power cord and terminal socket is easier.

Another object of the invention is to provide a power cord which consists of a plurality of wires. The non-connecting portion of the power cord is bonded to a flat form to facilitate wiring management.

Yet another object of the invention is to provide a terminal socket that has a cap to seal the terminal socket. The cap has two axle hubs to couple with a clipping member to facilitate plugging in and pulling out.

The foregoing, as well as additional objects, features and advantages of the invention will be more readily apparent from the following detailed description, which proceeds with reference to the accompanying drawings.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
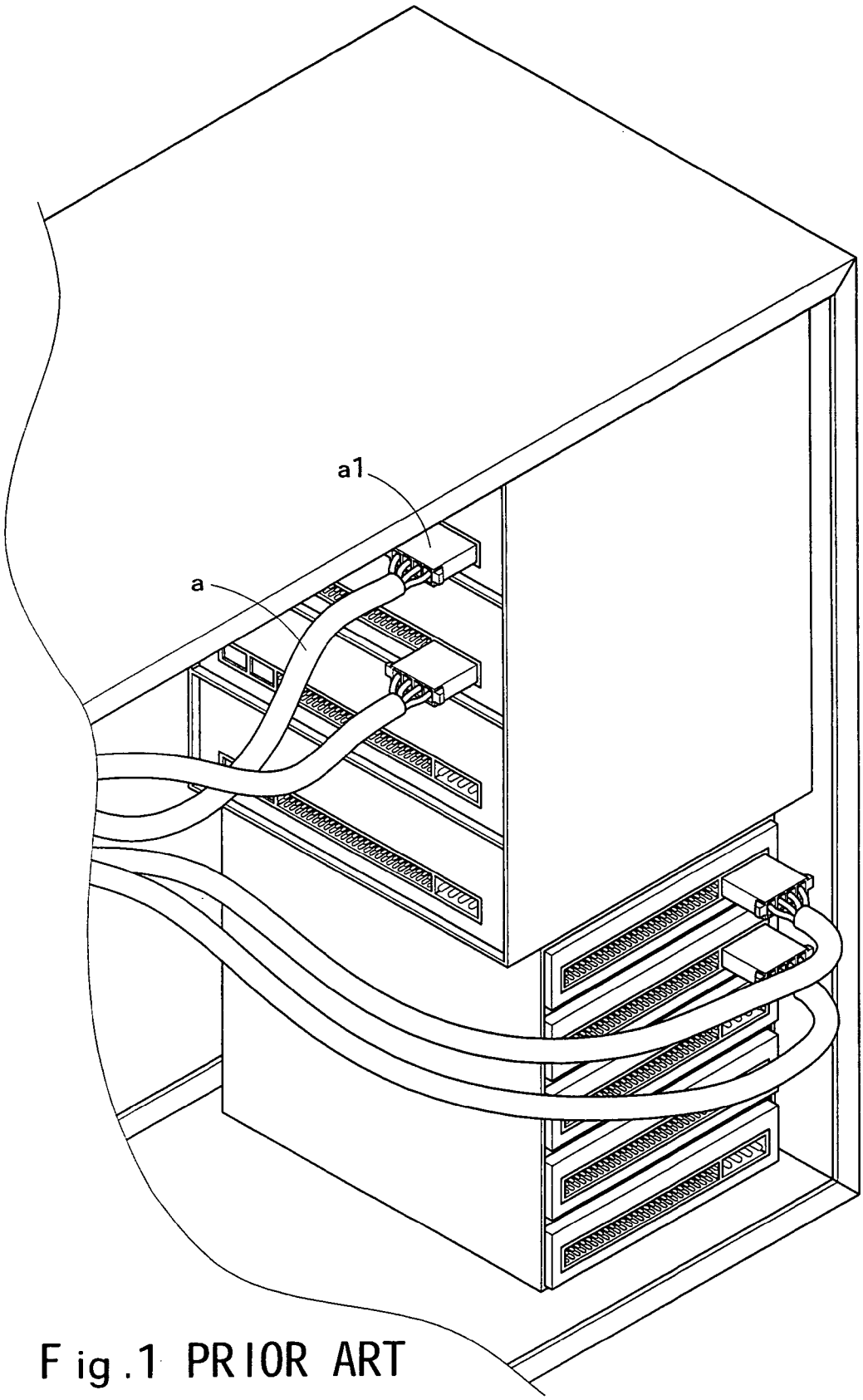
Fig.1 PRIOR ART
FIG. 1 is a schematic view of a conventional power cord connecting condition.
Figure 2:
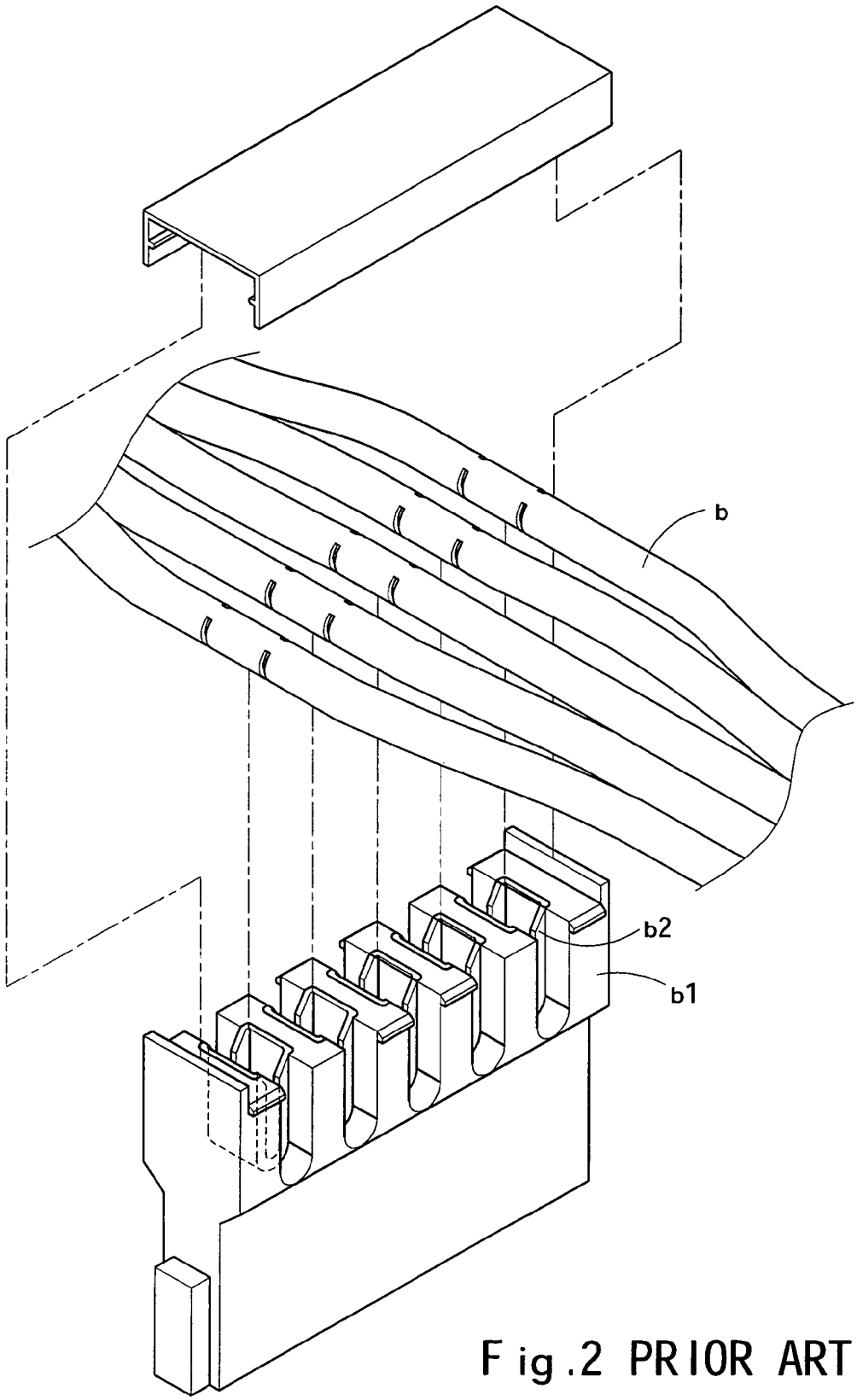
Fig.2 PRIOR ART
FIG. 2 is a schematic view of another conventional piercing power cord.
Figure 3:
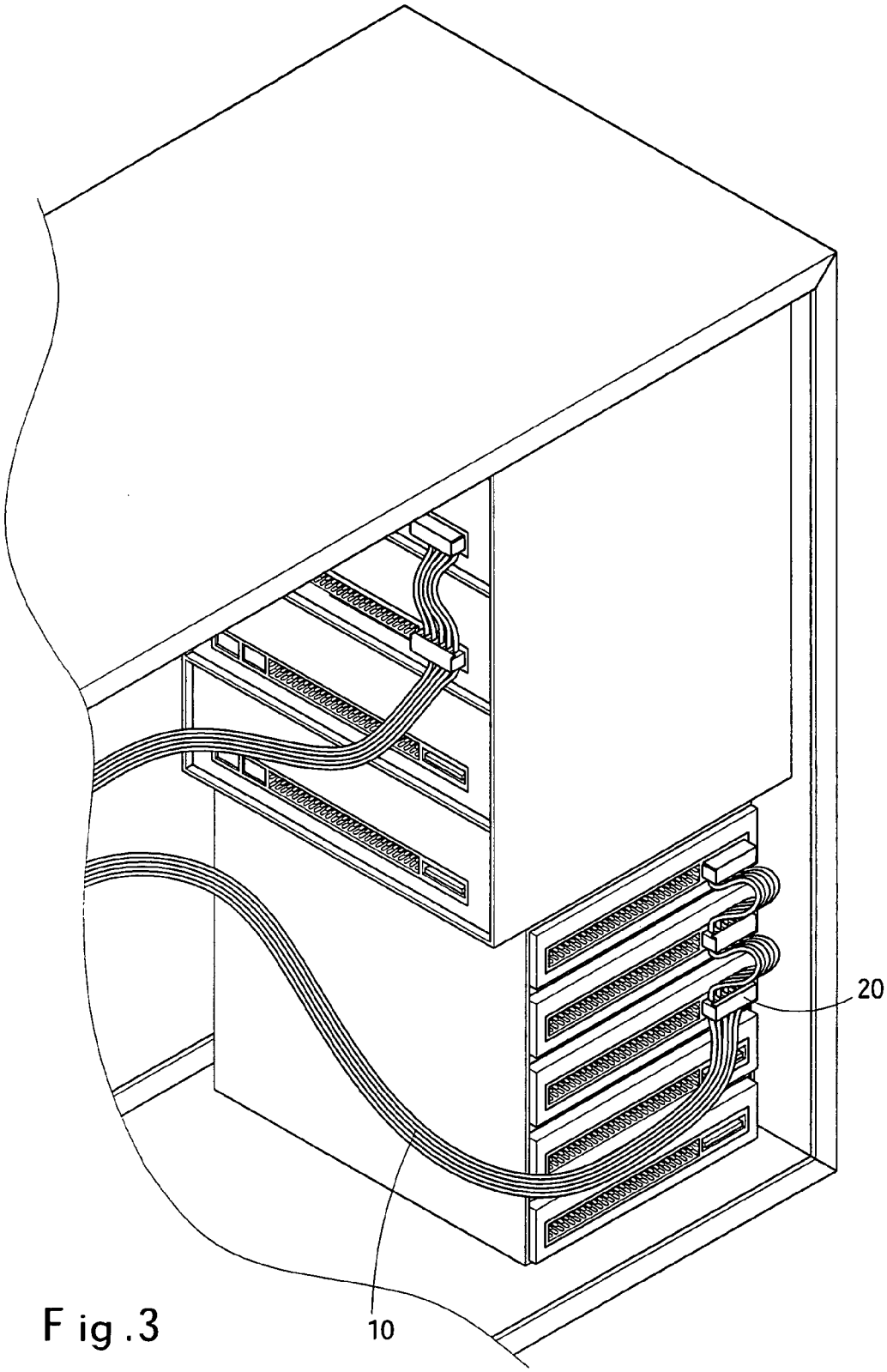
FIG. 3 is a schematic view of the power cord of the present invention in a connecting condition.
Figure 4:
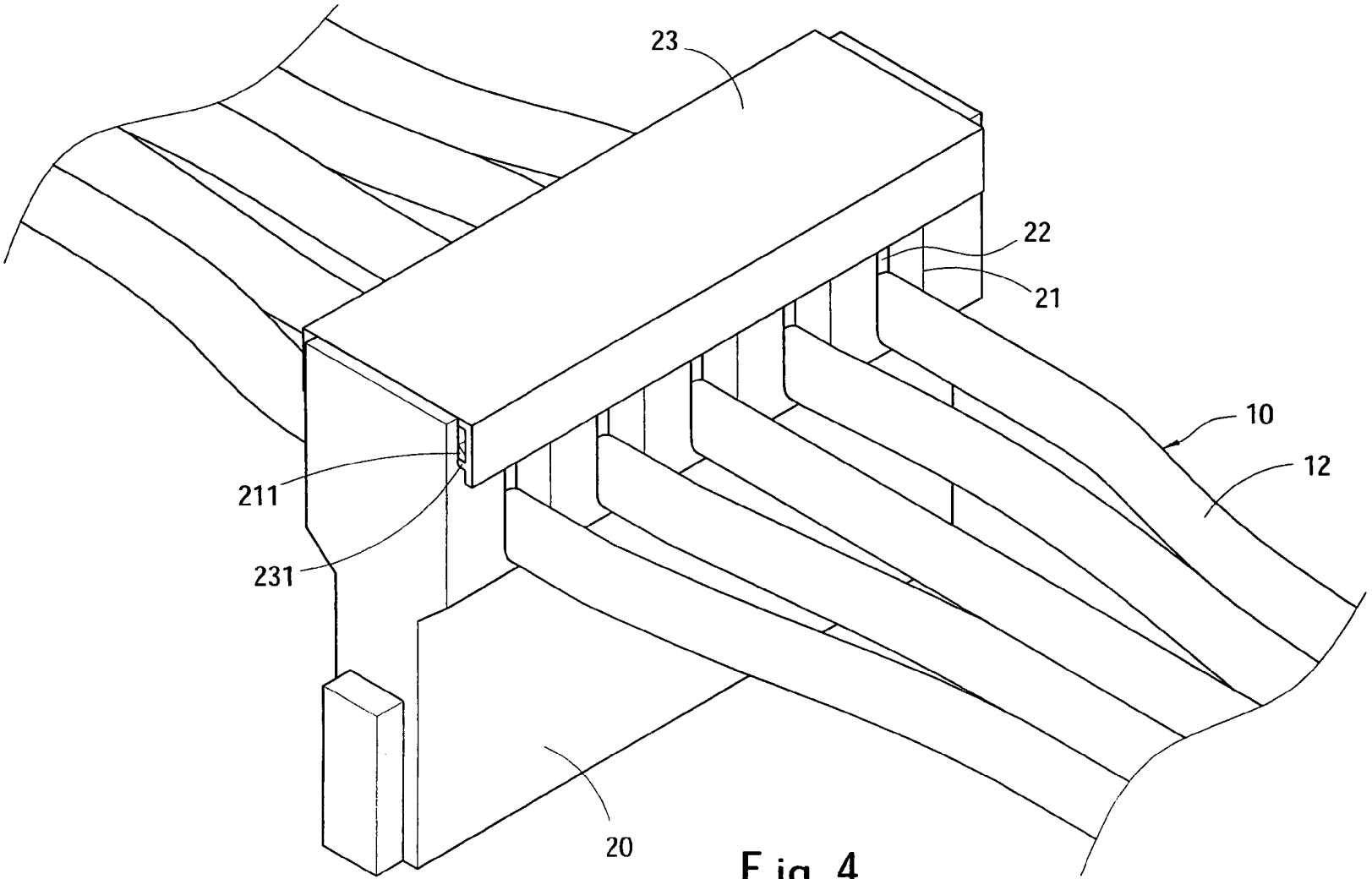
FIG. 4 is a schematic view of the power cord and terminal socket of the invention in a coupled condition.
Figure 5:
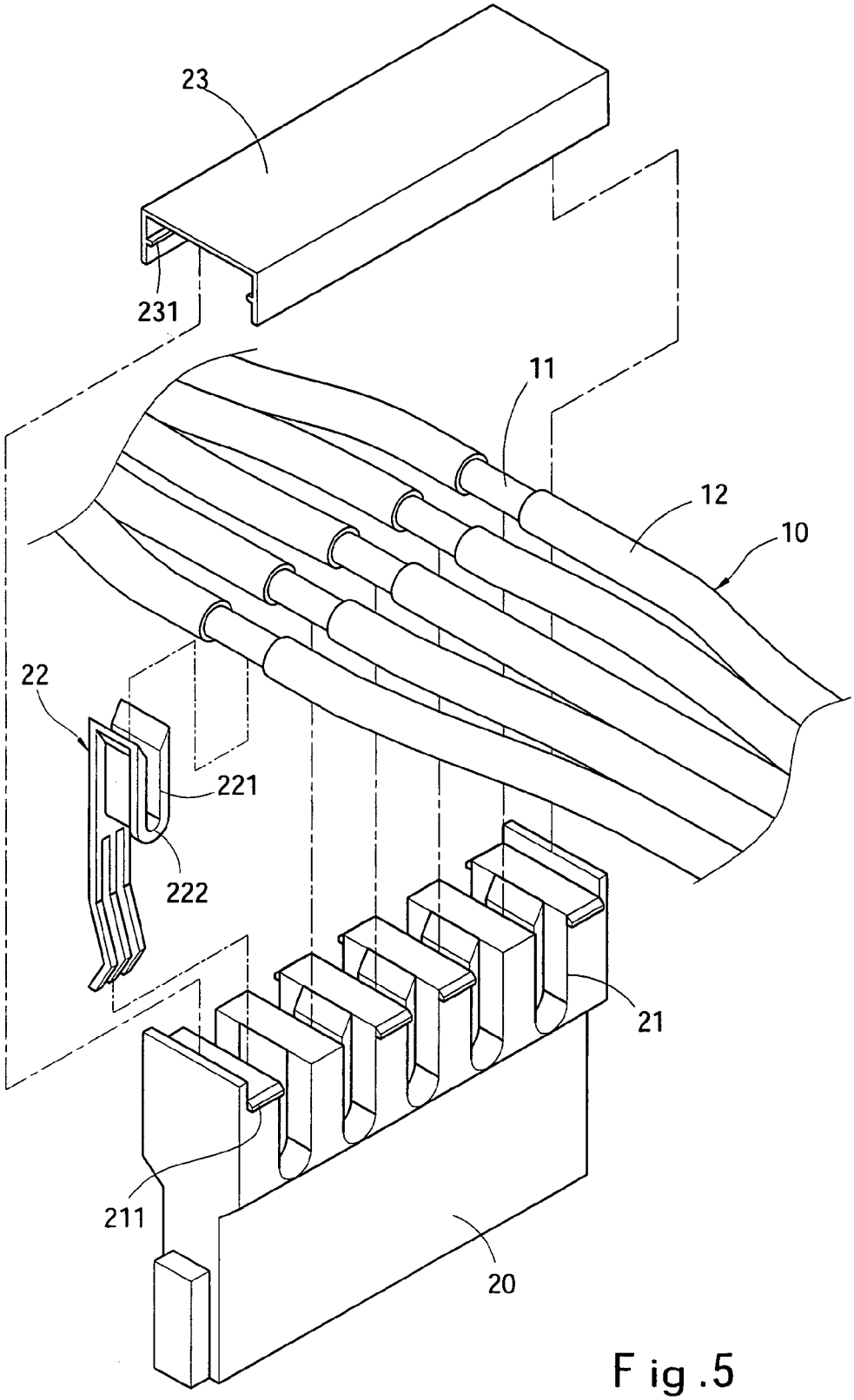
FIG. 5 is an exploded view of the power cord and terminal socket of the present invention.
Figure 7:
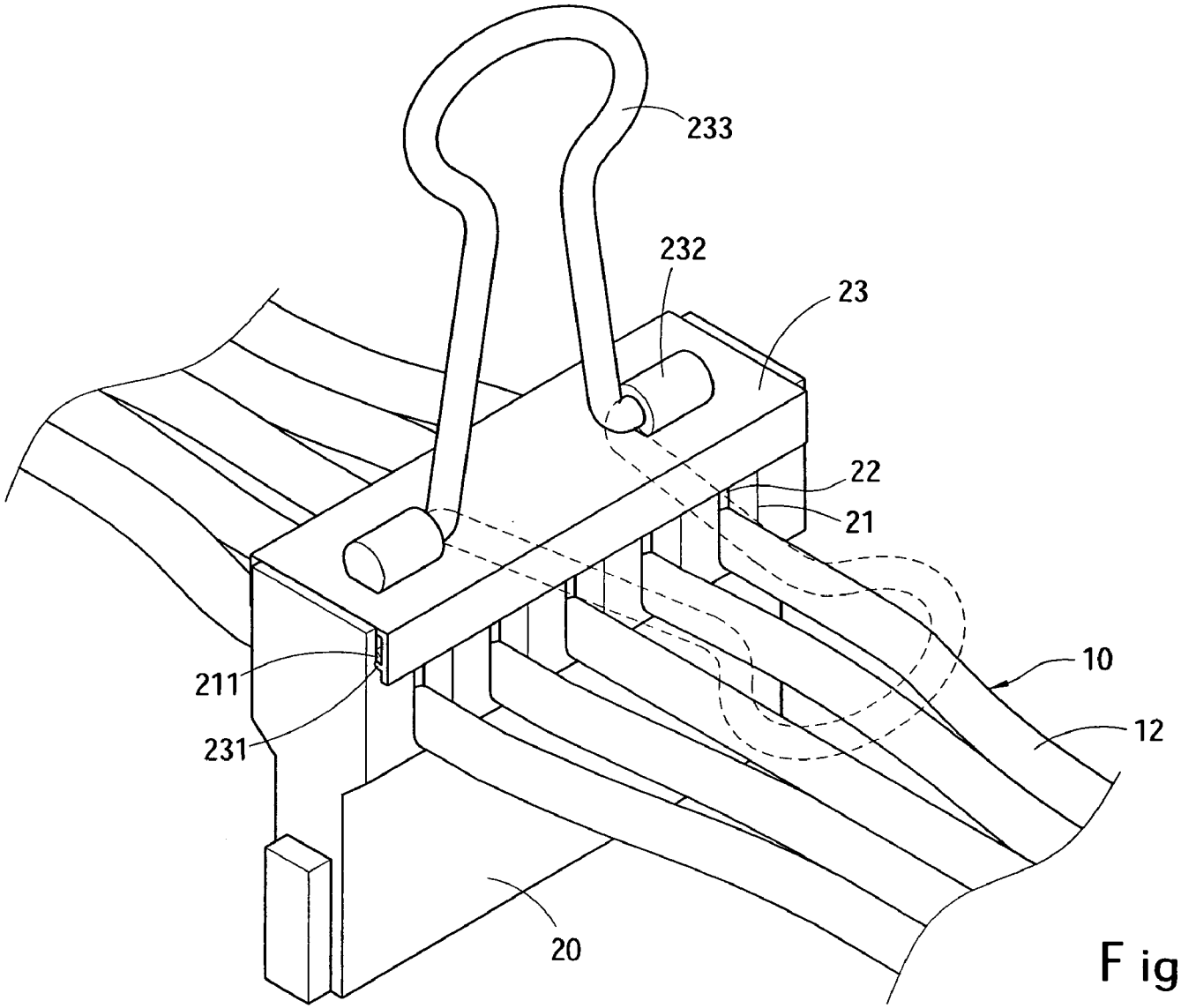
FIG. 7 is a schematic view of the power cord and terminal socket of the present invention in a use condition.

Please referring to FIGS. 3, 4 and 5, the present invention includes a power cord 10 which consists of a plurality of wires each has a conductive core 11 covered by an insulation layer 12. The power cord 10 has at least one connecting portion in which the conductive core 11 has a portion or entire section bare and exposed outside the insulation layer 12. The non-connecting portion of the wires is bonded to form the power cord 10 in a flat manner to facilitate bending and wiring management. Each wire connecting portion of the power cord 10 is coupled with a terminal socket 20 which has a coupling trough 21 corresponding to the power cord 10. The coupling trough 21 has a conductive terminal 22 corresponding to the bare conductive core 11 to form a plane connection in a vertical direction. The terminal socket 20 has a cap 23 to seal the conductive terminal 22. The coupling trough 21 has a retaining section 211 corresponding to an anchor section 231 formed on the cap 23 that may be coupled for anchoring. Referring to FIG. 7, the cap 23 further has two axle hubs 232 to pivotally couple with a clipping member 233 to facilitate plugging and decoupling with the terminal socket 20.

Figure 6:
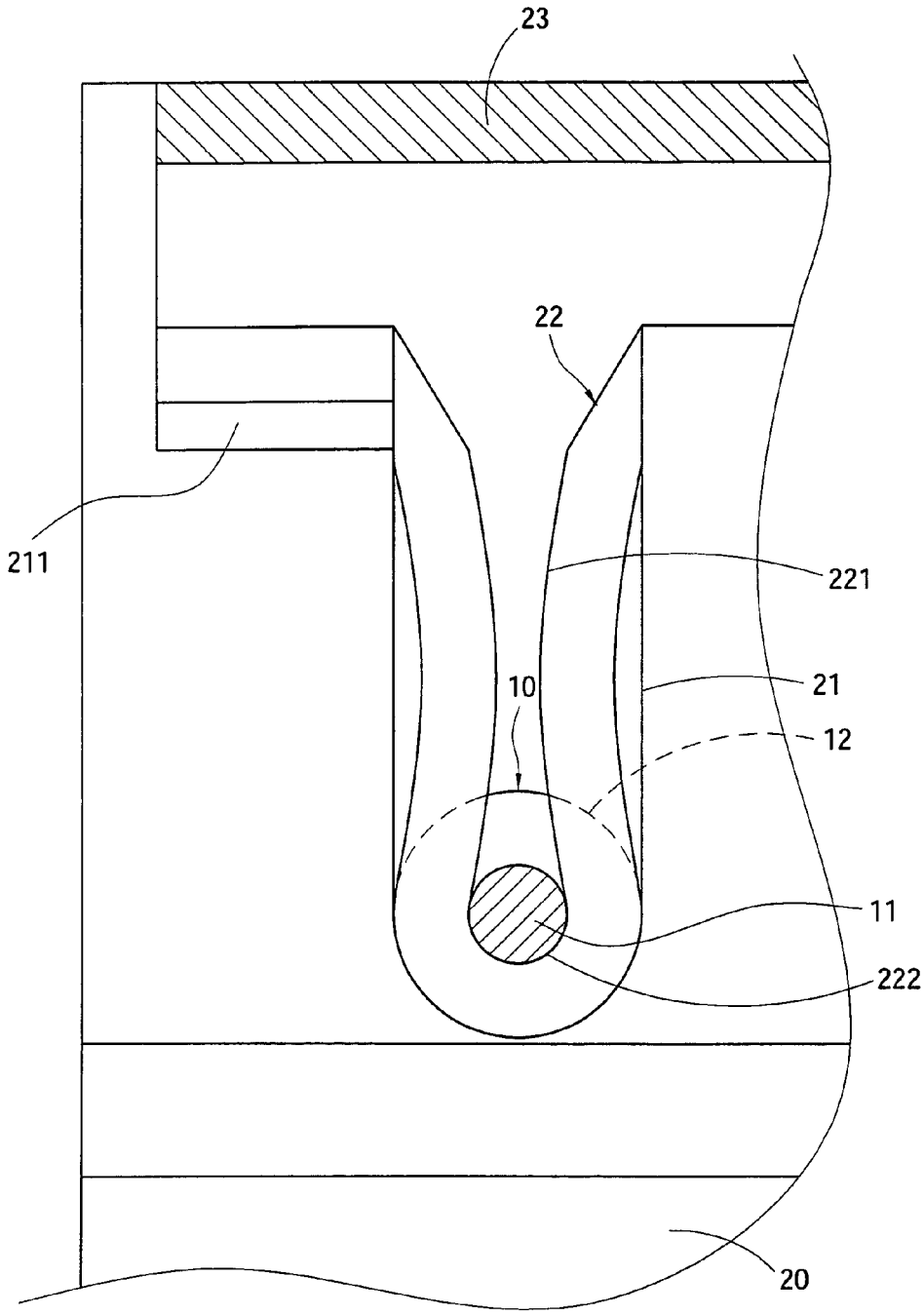
FIG. 6 is a sectional view of the power cord and terminal socket of the present invention in a coupled condition.

Referring to FIG. 6, the invention adopts the plane contact to establish electric connection between the conductive terminal 22 of the terminal socket 20 and the conductive core 11 of the power cord 10. Because the plane contact provides a larger contact area, electric connection between the power cord 10 and the terminal socket 20 are more secure without generating pulse sparks when current passes through in a large amount. The conductive terminal 22 has an arched conductive channel 221 and a conductive trough 222 communicating with the conductive channel 221 in contact with the contact surface of the conductive core 11. The conductive channel 221 has a width equal to or smaller than the diameter of the conductive core 11 or is elastic so that the conductive core 11 and the conductive terminal 22 can maintain electric connection without disruption. Moreover, referring to FIG. 7, as the power cord 10 and the terminal socket 20 are coupled in a vertical fashion, in normal conditions the clipping member 233 does not obstruct the bending power cord 10, and may be positioned in parallel with the power cord 10 without taking extra space. To plug in or pull out the terminal socket 20, turn the clipping member 233 about the axle hubs 232 to a position parallel with the terminal socket 20, the terminal socket 20 may be plugged in or pulled out easily.

The terminal socket 20 according to the invention is not limited to the SATA specification as shown in the drawings. It also may be adapted to the electric sockets of AT/ATX specifications or the like for electric transmission. Operation and assembly are substantially the same, thus details are omitted.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A power cord electric connection structure, comprising:

a power cord having a conductive core and an insulation layer covering the conductive core, and at least one connecting portion in which the conductive core is bare and exposed outside the insulation layer; and at least one terminal socket formed to receive the bare conductive core coupled with the power cord on the connecting portion having a coupling trough corresponding to the power cord, the coupling trough having a conductive terminal to form a plane contact substantially along an entire length of the bare conductive core, the conductive terminal has a conductive channel and a conductive trough communicating with the conductive channel that forms the plane contact with the conductive core, and the conductive channel has a width smaller than the diameter of the conductive core.

2. The power cord electric connection structure of claim 1, wherein the conductive terminal is connected electrically with the conductive core in a vertical direction.

3. The power cord electric connection structure of claim 1, wherein the power cord includes a plurality of wires.

4. The power cord electric connection structure of claim 3, wherein the wires outside the connecting portion are bonded to form a flat power cord.

5. The power cord electric connection structure of claim 1, wherein the terminal socket further has a cap to seal the conductive terminal.

6. The power cord electric connection structure of claim 5, wherein the coupling trough has a retaining section on two sides corresponding to an anchor section formed on the cap.

7. The power cord electric connection structure of claim 5, wherein the cap has two axle hubs pivotally coupled with a clipping member.

8. The power cord electric connection structure of claim 1, wherein the terminal socket is an electric socket of SATA specifications.

9. The power cord electric connection structure of claim 1, wherein the terminal socket is an electric socket of AT/ATX specifications.

10. The power cord electric connection structure of claim 1, wherein the conductive core of the power cord has a longitudinal axis and wherein the at least one connecting portion extends a distance along the longitudinal axis, the conductive terminal which is in contact with the insulation layer being engaged at least substantially for all of the distance of the at least one connection portion.

11. The power cord electric connection structure of claim 1, wherein the terminal socket has a front end and a rear end and wherein the conductive terminal extends between the front end and rear end of the terminal socket, the bare conductive core being in continuous contact with the conductive terminal from the front end to the rear end of the terminal socket.

12. The power cord electric connection structure of claim 11, wherein each coupling trough of the terminal socket has only one contact with the conductive core.

13. The power cord electric connection structure of claim 1, further comprising a cap for closing the conductive terminal, the cap having a top side and an opposed bottom side, the bottom side facing the conductive terminal, the top side of the cap having two axle hubs pivotally coupled with a clipping member, the clipping member being pivotable between a first position and a second position, the first position being parallel with the terminal socket for removal and the second position being perpendicular to the first position, the clipping member being parallel to the power cord in the second position.

14. A power cord electric connection structure, comprising:

a power cord having a conductive core and an insulation layer covering the conductive core, and at least one connecting portion in which the conductive core is bare and exposed outside the insulation layer;

at least one terminal socket formed to receive the bared conductive core coupled with the power cord on the connecting portion having a coupling trough corresponding to the power cord, the coupling trough having a conductive terminal to form a plane contact along a length of the bare conductive core; and a cap for closing the conductive terminal, the cap having a top side and an opposed bottom side, the bottom side facing the conductive terminal, the top side of the cap having two axle hubs pivotally coupled with a clipping member, the clipping member being pivotable between a first position and a second position, the first position being parallel with the terminal socket for removal and the second position being perpendicular to the first position, the clipping member being parallel to the power cord in the second position.

15. The power cord electric connection structure of claim 14, wherein the coupling trough has a retaining section on two sides corresponding to an anchor section formed on the cap.

16. The power cord electric connection structure of claim 14, wherein the conductive core of the power cord has a longitudinal axis and wherein the at least one connecting portion extends a distance along the longitudinal axis, the conductive terminal which is in contact with the insulation layer being engaged at least substantially for all of the distance of the at least one connection portion.

17. The power cord electric connection structure of claim 14, wherein the terminal socket has a front end and a rear end and wherein the conductive terminal extends between the front end and rear end of the terminal socket, the bare conductive core being in continuous contact with the conductive terminal from the front end to the rear end of the terminal socket.

18. The power cord electric connection structure of claim 17, wherein each coupling trough of the terminal socket has only one contact with the conductive core.

* * * * *